US005617195A

United States Patent [19]

Torimaru et al.

[11] Patent Number: 5,617,195

[45] Date of Patent: Apr. 1, 1997

[54] CLEANING UNIT AND TONER RECOVERY SYSTEM FOR IMAGE FORMATION UNIT

[75] Inventors: Satoru Torimaru; Junichirou Sameshima; Norio Hokari; Yukio Hayashi; Mikio Kobayashi; Shuji Iseki; Ryouichi Tsuruoka, all of Kanagawa, Japan

[73] Assignee: Fuji Xerox Co., Ltd., Tokyo, Japan

[21] Appl. No.: 523,828

[22] Filed: Sep. 6, 1995

[30] Foreign Application Priority Data

Sep. 7, 1994 [JP] Japan ..... 6-239546
Apr. 14, 1995 [JP] Japan ..... 7-113728

[51] Int. Cl.[6] ..... G03G 21/00

[52] U.S. Cl. ..... 399/27; 399/123; 399/358

[58] Field of Search ..... 355/298, 260, 355/200, 210, 271, 300

[56] References Cited

U.S. PATENT DOCUMENTS 4,690,542 9/1987 Furuta et al. ..... 355/327
4,982,230 1/1991 Ogura et al. ..... 355/206
5,400,127 3/1995 Arai et al. ..... 355/298

FOREIGN PATENT DOCUMENTS 59-168467 9/1984 Japan .
60-230178 11/1985 Japan .
62-170967 U 10/1987 Japan .
64-38668 U 3/1989 Japan .
1-181056 U 12/1989 Japan .

*Primary Examiner*—Joan H. Pendegrass
*Assistant Examiner*—Quana Grainger
*Attorney, Agent, or Firm*—Finnegan, Henderson, Farabow, Garrett & Dunner, L.L.P.

[57] ABSTRACT

Residual toner is removed from a belt-type paper support by means of a brush roll and blade. The removed toner is guided to a waste toner storage vessel by means of a screw member. A sensor indicates when the toner storage vessel is full.

7 Claims, 12 Drawing Sheets

CLEANING UNIT AND TONER RECOVERY SYSTEM FOR IMAGE FORMATION UNIT

BACKGROUND OF THE INVENTION

This invention relates to a cleaning unit for removing residual toner adhering onto an image support or a paper support in an image formation unit such as an electrophotographic copier or a laser beam printer and in particular to a cleaning unit having transport means disposed in a storage vessel and using information of a turn state, etc., of the transport means to sense that the storage vessel fills with collected toner.

An image formation unit using an electrophotographic system for preparing record paper, such as an electrophotographic copier or a laser beam printer, is provided with a cleaning unit for removing residual toner adhering to the surface of a photosensitive drum after a toner image is formed for an image support such as a photosensitive drum and is transferred to paper. Known as the cleaning unit are, for example, a cleaning unit using a blade as disclosed in Japanese Utility Model Laid-Open No. Sho 64-38668, etc., and a cleaning unit using a blade and a rotating brush as disclosed in Japanese Utility Model Laid-Open No. Sho 62-170967. As shown in the conventional examples, the operation of pressing the blade against the photosensitive drum surface for scraping off toner and the operation of operating the two members of the blade and brush for removing residual toner can be performed.

In the conventional examples, the image formation unit uses a photosensitive drum as an image support. To an image formation unit using a photosensitive belt as an image support, a cleaning unit using a rotating brush and a blade is also applied, for example, as disclosed in Japanese Utility Model Laid-Open No. Hei 1-181056. In the example of the cleaning unit applied to the photosensitive belt, means for transporting collected toner is placed at a position where toner in the lower part of the main unit of the cleaning unit drops, and a long pipe containing a screw is connected for transporting toner to a collection box placed at a position away from the main unit. Further, in the conventional example, means for sensing that the toner collection box fills with toner is placed and when the collected toner stored in the toner collection box reaches a predetermined amount, the collection box is replaced with a new one. When the toner collection box is placed at a position away from the main unit of the cleaning unit as in the conventional example, the toner collection box space need not be near the photosensitive member, thus the housing space of other components placed corresponding to the photosensitive member is not affected.

Sensing means such as a sensor is placed near the vessel storing collected toner shown in the conventional example and is used to sense that the collected toner accumulated in the vessel reaches a predetermined level. However, even if toner is stored in the collection vessel on one side, when the toner is sensed by the sensor, a full signal is output for instructing the operator to replace the collection box. Apart from the conventional example, in an example disclosed in Japanese Patent Laid-Open No. Sho 60-230178, etc., transport means is connected to the lower part of a toner collection box, collected toner is stored from the lower part of the vessel, and the toner stored in the vessel can be stored in a pressure seal condition.

In the conventional example, an optical sensor of transmission type is placed in the upper part of the collection box is placed and when toner is pushed up to a predetermined height, the optical sensor can sense that the collection box fills with the toner. When the main unit of the cleaning unit and the collection box are placed separately as in the conventional example, a transporter for transporting toner needs to be added between the two members; the configuration can be easily applied to a large unit. However, for a cleaning unit in a comparatively small image formation unit or a cleaning unit with a small toner collection amount or when a comparatively large collection box cannot be placed, it may also be advisable from maintenance of the unit, etc., to use means placing the collection box integral with the main unit of the cleaning unit.

Apart from the cleaning unit for an image support as described above, for example, an electrophotographic copier disclosed in Japanese Patent Laid-Open No. Sho 59-168467 has a plurality of photosensitive drums placed corresponding to a paper transporter and transfers overlapped color toner images to a sheet of paper supported by the paper transporter for making a full color copy. The electrophotographic copier comprises means for writing marks to control toner image density, color displacement, etc., onto a conveyer belt member forming a part of the paper transporter and means for reading the mark image density. It reads the marks of the toner images formed on the belt for adjusting the image density, senses color displacement among the marks transferred from the photosensitive drums, and rewrites control information in a controller, then removes the marks by the cleaning unit for preventing extra toner from adhering to paper.

Thus, the electrophotographic copier for making a color copy as described above has a cleaning unit for removing toner placed for a conveyer belt member forming a part of a paper transporter. However, since the amount of collected toner is comparatively small at the cleaning unit placed for the belt member, if a collection box is combined with the main unit, space in which the vessel can be housed is limited. Further, the form of the storage vessel is limited because of space restriction as described above, also affecting the structure of a device for sensing that the vessel fills with toner, making it difficult to accurately sense it.

SUMMARY OF THE INVENTION

To solve problems of transporting collected toner and sensing that a collected toner storage vessel fills with stored toner when a cleaning unit is placed for a conveyer belt device, etc., as a paper support in a color electrophotographic copier, etc., an object of the invention is to provide a unit that can accurately sense that a toner storage vessel fills with toner, wherein transport means located in a cleaning unit main unit and transport means located in the vessel can be easily connected, comprising means for sensing that the vessel fills with toner from rotation information of the transport means placed in the vessel and means for inclining the vessel downstream of a toner transport direction for moving toner stored in the vessel to the depth of the vessel when the unit is maintained.

According to the invention, there is provided a cleaning unit for an image formation unit comprising a cleaning member being placed in contact with an image support or a paper support, a toner storage vessel for storing waste toner, a guide member being located at a position where toner on a bottom of the cleaning member drops for sending waste toner to the toner storage vessel, a screw member being located movably in the toner storage vessel, and a sensor for sensing a move of the screw member.

The cleaning unit may further include an energizing member for suppressing a move of the screw member.

According to the invention, there is provided a cleaning unit for an image formation unit comprising a cleaning member being placed in contact with an image support or a paper support, a toner storage vessel for storing waste toner, a guide member being located at a position where toner on a bottom of the cleaning member drops for sending waste toner to the toner storage vessel, a screw member being located in the toner storage vessel, and a sensor for sensing a rotation state of the screw member.

According to the invention, there is provided an image formation unit comprising a main unit of the image formation unit, a main unit frame supported in a state in which it can be inserted into and drawn out from the main unit of the image formation unit, a transfer module supporting a paper conveyer belt and being swingable for the main unit frame in a state in which the main unit frame is drawn out from the main unit of the image formation unit, and a cleaning unit being integral with the transfer module and having at least a toner storage vessel.

In the image formation unit, the cleaning unit can have a screw member being disposed in the toner storage vessel and divided into a toner transport part and a sensed part and a lock member for locking the sensed part of the screw member in a state in which it is moved to the main unit frame when the transfer module is swung from the main unit frame.

The image formation unit may further include an unlock member for unlocking the sensed part of the screw member locked to the main unit frame when the transfer module is mounted on the main unit frame.

Further, in the invention, toner transport means is placed in toner removal means and transport means for sending toner to collected toner storage means and rotation transport means for transporting toner in a collected toner storage vessel in the collected toner storage means are provided. Means for sensing the shaft rotation state is placed for the transport means placed in the collected toner storage means. A rail member for drawing out the transfer module horizontally to the main unit frame of image formation unit and a rotation shaft for swingably supporting the transfer module at a position where it is furthermore drawn out are provided. The rotation shaft is placed at a position perpendicular to a toner transport direction downstream of the transport direction by the rotation transport means.

In the invention, the means for sensing the shaft rotation state for the transport means placed in the collected toner storage means has a shaft movable among the first position before the sensor senses that the collected toner storage means fills with toner, the second position for the sensor to sense that the collected toner storage means fills with toner, and the third position for mounting or demounting the collected toner storage means. Further, in the invention, the shaft of the transport means placed in the collected toner storage means is divided into parts corresponding to the toner transport section and the actuator and connection means are located between the two shafts. At the third position for mounting or demounting the collected toner storage means, the shaft on the actuator side is moved to the side opposite to the collected toner transport direction and locked and the two shafts are disconnected from each other. In this state, the collected toner storage means can be mounted or demounted. In addition to the structure, in the invention, the shaft of the transport means placed in the collected toner storage means is divided into parts corresponding to the toner transport section and the actuator and connection means are located between the two shafts. Provided are means for moving the shaft on the actuator side to the side opposite to the collected toner transport direction and locking it and disconnecting the two shafts in a state in which the transfer module is drawn out horizontally to the main unit frame of the image formation unit and swung at a position where the transfer module is furthermore drawn out, and means for automatically unlocking the shaft on the actuator side in a state in which the transfer module is restored to the horizontal position.

The image formation unit to which the invention is applied comprises means for writing marks to sense the image density, etc., onto the conveyer belt supporting paper and controlling the copy image density, etc., and when paper is supported by the conveyer belt, removes the marks by the cleaning unit. The cleaning unit has the collected toner storage vessel disposed detachably in the main unit and when the vessel fills with toner, it is replaced with a new one. The screw member for pushing toner into the storage vessel is placed for the vessel. When the vessel fills with toner, if resistance to the screw member increases, lowering the number of revolutions or stopping rotation of the screw member or moving the screw member axially, the sensor senses that the vessel fills with toner according to rotation state information of the screw member.

Further, since the opening for transferring toner between the transport screw member of the main unit and the screw member of the storage vessel is opened by mounting the storage vessel of the invention on the main unit, if the vessel provided with the screw member is not connected, toner does not leak out. In addition to the structure, in the invention, the conveyer belt and the support member are formed as the transfer module and the transfer module can be swung via the supporting shaft member disposed in the main unit of the image formation unit. The cleaning unit and the storage vessel are previously attached to the transfer module, whereby when the transfer module is inclined in maintenance, etc., of the transfer module, toner in the storage vessel is moved to the depth of the vessel so that the depth side of the vessel into which toner is hard to be pushed by the screw can also fill with toner. Therefore, toner accumulating in the part of the screw member placed in the storage vessel can be removed by inclining the transfer module, so that load when the later collected toner is transported by the screw can be reduced and the transport section is not clogged with toner, preventing erroneous sensing at the transport section.

DETAILED DESCRIPTION OF THE PREFERRED EMBODIMENTS

Referring now to the accompanying drawings, there is shown a cleaning unit for an image formation unit of the invention.

(Embodiment 1)

Figure 1:
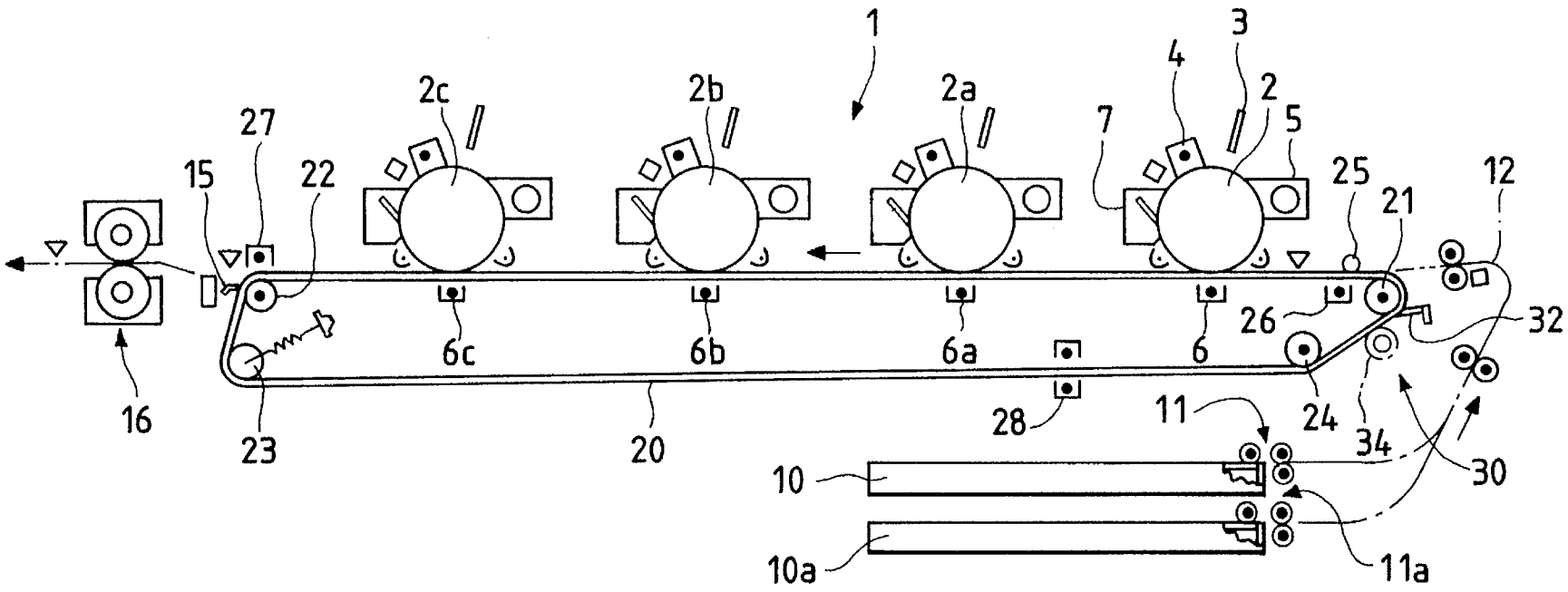
FIG. 1 is an illustration showing the configuration of an image formation unit to which a cleaning unit of the invention can be applied.

FIG. 1 shows the configuration of a color electrophotographic copier to which the cleaning unit of the invention can be applied, wherein a plurality of photosensitive drums 2, 2*a*, . . . are placed in an image formation section of an image formation unit 1. A lens 3 for transmitting light of a write image, a charge corotron 4, a developing device 5, a transfer corotron 6, and a cleaning unit 7 are placed, as shown in the photosensitive drum 2, for each of the photosensitive drums. As with general electrophotographic copiers, a toner image is formed for the photosensitive drums and is transferred to paper. As with conventional color electrophotographic copiers, the image formation unit 1 forms a color toner image in four colors of black, yellow, magenta, and cyan.

As described above, image transfer parts of photosensitive drums are placed linearly and a conveyer belt 20 as a paper support is placed on roller members for driving at a given rate. The roller members for guiding the conveyer belt 20 consist of a drive roller 21, a tension roller 23, and idler rollers 22 and 24. The charge corotron 26 and the press roller 25 are placed near a position corresponding to the drive roller 21 and paper is transported along the image transfer parts with the paper electrostatically held to the surface of the conveyer belt 20. The conveyer belt 20 and the roller members 21–24 for guiding the belt are formed in one piece as a transfer module 70 as discussed later with reference to FIG. 13.

To feed paper to the conveyer belt 20, paper feed trays 10 and 10*a* are placed in a paper feed section and paper feeders 11 and 11*a* are placed in paper feed parts of the paper feed trays 10 and 11*a* for feeding paper of a specified size from the tray via a paper transport passage 12 to the paper feed section to the conveyer belt 20. Each time a sheet of paper passes through the image transfer part of each photosensitive drum, a color toner image is overlaid and transferred from the photosensitive drum. When the sheet of paper has passed through the position of the last photosensitive drum 2*c*, the resulting 4-color toner image is supported on the sheet of paper.

An electricity removal corotron 27 is placed downstream of the paper transport face of the conveyer belt 20 for supplying charges of opposite polarity to the sheet of paper electrostatically held to the conveyer belt 20 for stripping the sheet of paper from the conveyer belt 20. Further, a stripping claw 15 is placed at a bend of the conveyer belt 20 made by the idler roller 22 for stripping the sheet of paper from the conveyer belt 20 and guiding the sheet of paper supporting the color toner image to a fixing device 16. Heat and pressure are applied to it by the fixing device 16 for fixing it and a resulting color copy is discharged to a discharge tray. After the sheet of paper is stripped from the conveyer belt 20 as described above, the conveyer belt 20 is moved through a return passage to the position supporting another sheet of paper. In the invention, a cleaning unit 30 as means for removing residual toner is placed between the idler roller 24 and the drive roller 21 for cleaning the paper support face of the conveyer belt 20.

General color image formation unit is provided with means for correcting color displacement of yellow, magenta, cyan, and black and means for adjusting the image density to maintain good image quality. The image formation unit to which the invention is applied also uses a method in which predetermined image density marks, such as patches, are prepared directly on the conveyer belt 20 for colors of yellow, magenta, cyan, and black and the image density is read with sensing means such as a photosensor and compared with a target value for adjusting the developing condition (developing bias) to adjust the image density. As a color displacement correction method, colors of yellow, magenta, cyan, and black are prepared on the conveyer belt 20 as marks, such as ladders, at predetermined intervals, mark pitches are read by a sensor, and displacement from the ideal position at which the mark should exist is calculated for adjusting the image write timing onto the photosensitive drums. The image quality adjustment means are executed at preset timing corresponding to the operation when paper is transported or copy operation is started. Then, in the invention, as described above, a color toner image is formed directly on the conveyer belt 20 and the color toner image formed on the conveyer belt 20 is cleaned in the portion just preceding the position for supporting paper, thereby preventing toner from adhering to paper.

Figure 2:
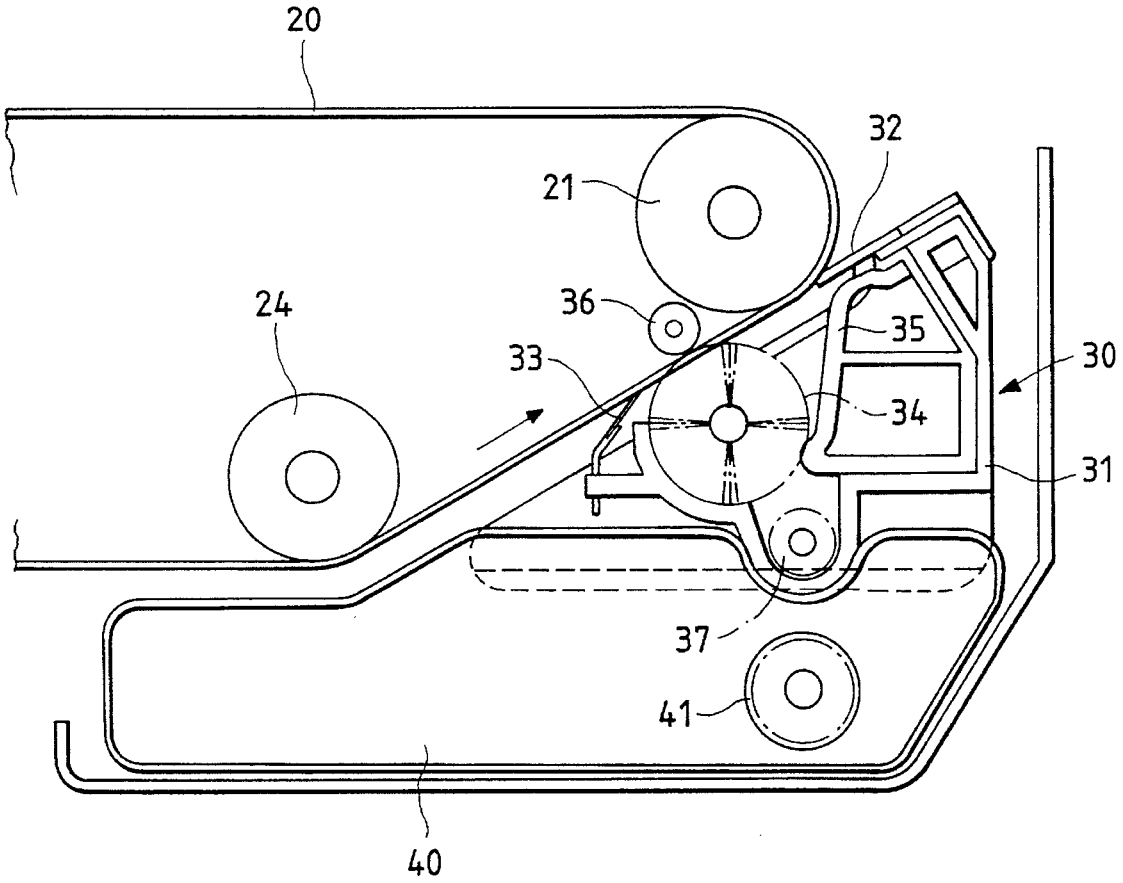
FIG. 2 is an illustration of a cleaning unit placed for a conveyer belt.
Figure 3:
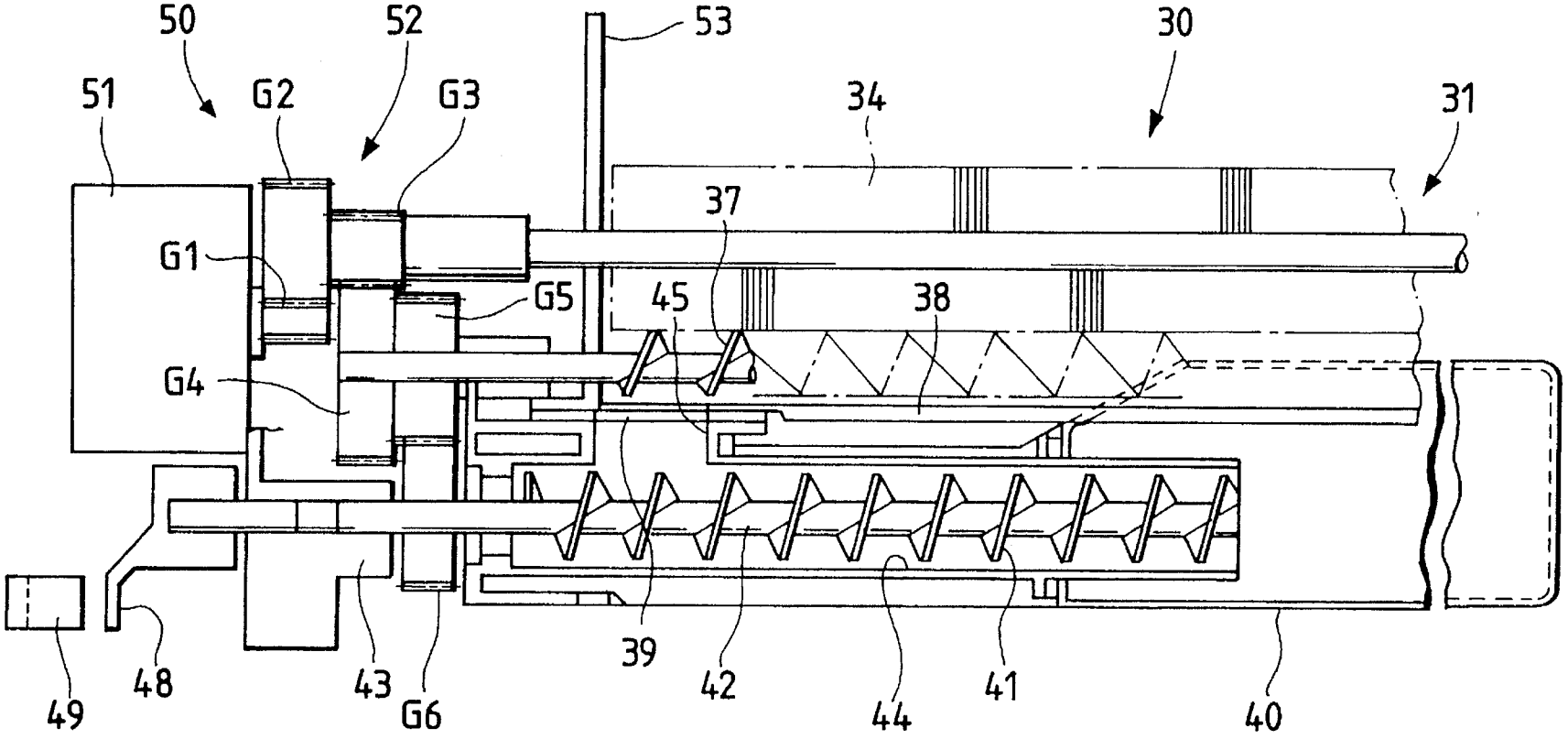
FIG. 3 is an illustration showing the structure of the cleaning unit in FIG. 2.

As described above, only a blade member 32 and a brush roll 34 are shown in FIG. 1 for the cleaning unit 30 as toner removal means placed for the conveyer belt 20; in fact, the cleaning unit 30 is constructed as shown in FIGS. 2 and 3. In the cleaning unit 30 shown in FIG. 2, a main unit 31 is formed with a housing opening corresponding to the belt, the upstream side of the opening is sealed by a seal member 33, and the brush roll 34 and the blade member 32 are placed for forming means for removing toner adhering to the belt surface. Also, a flicker bar 35 is placed for the brush roll 34 for scraping off toner adhering to the brush surface. Further, a screw member 37 as rotating transport means is placed in the lower part of the housing of the main unit 31 for transporting the toner scraped off from the belt surface in a discharge direction.

A storage vessel 40 as toner storage means is disposed detachably in the lower part of the main unit 31 of the cleaning unit 30 and collected toner is stored in the storage vessel 40. A screw member as rotating transport means is placed in the storage vessel 40 and collected toner is pushed into the vessel by the screw member, as described below.

Toner transport means placed in each of the main unit 31 and the storage vessel 40 drives the brush roll 34 and screw members 37 and 41 via a gear device 52 by a motor 51 of a drive 50, as shown in FIG. 3. In the gear device 52, an output gear G1 of the motor 51 is meshed with a drive gear G2 of the brush roll 34, a gear G4 of the screw member 37 is driven via an intermediate gear G3 disposed on a shaft of the brush roll 34, and a drive gear G6 of the screw member 41 is driven via an intermediate gear G5 disposed on a shaft of the screw member 37. The rotation speed for each of the brush roll and screw members is set to an optimum value by appropriately setting the reduction gear ratio of the gears.

In the cleaning unit shown in FIG. 3, a groove-like guide member 38 for guiding collected toner is placed in the lower part of the main unit 31 and a discharge port 39 is placed in the vicinity of the end of the screw member 37 placed in the guide member 38 for discharging collected toner to the storage vessel 40. Further, the screw member 41 is located in the storage vessel 40 with the screw member 41 inserted into a pipe 44 and the pipe 44 is projected by a predetermined length toward the inside of a toner storage section of the storage vessel 40. The pipe 44 into which the screw member 41 is inserted is formed with a receptacle 45 to which the discharge port 39 placed in the vicinity of the end of the screw member 37 is connected. Toner collected at the main unit 31 is transported to the discharge port 39 by the screw member 37 and supplied through the receptacle 45 to the screw member 41. The toner received through the discharge port 39 from the screw member 37 and the receptacle 45 of the pipe 44 is transported inside the pipe 44 by the screw member 41 and pushed out from the end of the pipe 44 to the inside of the storage vessel 40 for discharge.

Figure 4:
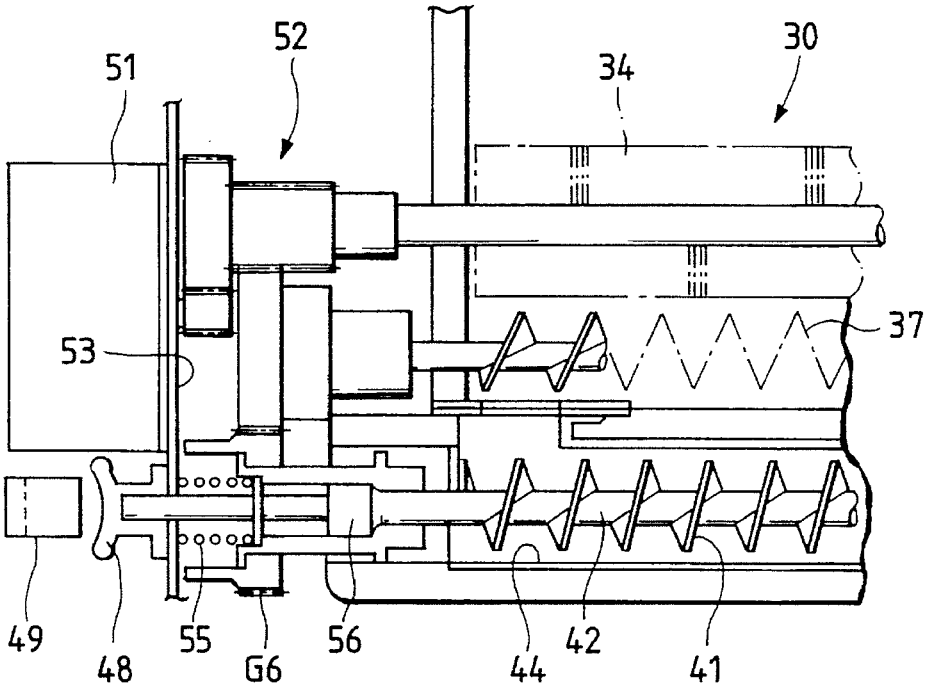
FIG. 4 is an illustration showing the structure of full sensing means.

The screw member 41 transports toner from the receptacle 45 to the end of the opening while it is turning in the pipe 44 as described above; the operation of transporting the toner by the screw member 41 causes a reaction force in an opposite direction to the transport direction to occur for a shaft 42 of the screw member 41. Then, the shaft 42 of the screw member 41 is supported by a thrust bearing 43, an actuator 48 is placed in the support end of the shaft 42, and a sensor 49 is placed for the actuator 48, whereby means for sensing a state in which the shaft 42 is moved by the reaction force of the screw member 41 can be provided. However, if the screw member shaft 42 is slidably supported simply by the thrust bearing 43, when a reaction force acts even a little when toner is transported, the shaft 42 causes the actuator 48 to move and it is assumed that the sensor 49 outputs actuator sensing information. Resultantly, a problem occurs in which a full signal is output although the storage vessel 40 does not fill with collected toner. To solve such a problem, for example, a thrust terminal 56 can be placed at the end of the shaft 42 of the screw member 41 and a spring 55 can be located between the thrust terminal 56 and a frame 53 of the cleaning unit 30, as shown in FIG. 4, whereby the spring 55 energizes the shaft 42 of the screw member 41 to the right of the figure for holding the actuator 48 in a direction away from the sensor 49. Therefore, in FIG. 4, when an axial reaction force produced by resistance of toner transported in the pipe 44 is weaker than a press force of the spring 55 with respect to the screw member 41 located in the storage vessel 40, the shaft 42 does not move to the left of the figure and the toner transporting operation in the pipe 44 is continued.

Figure 5:
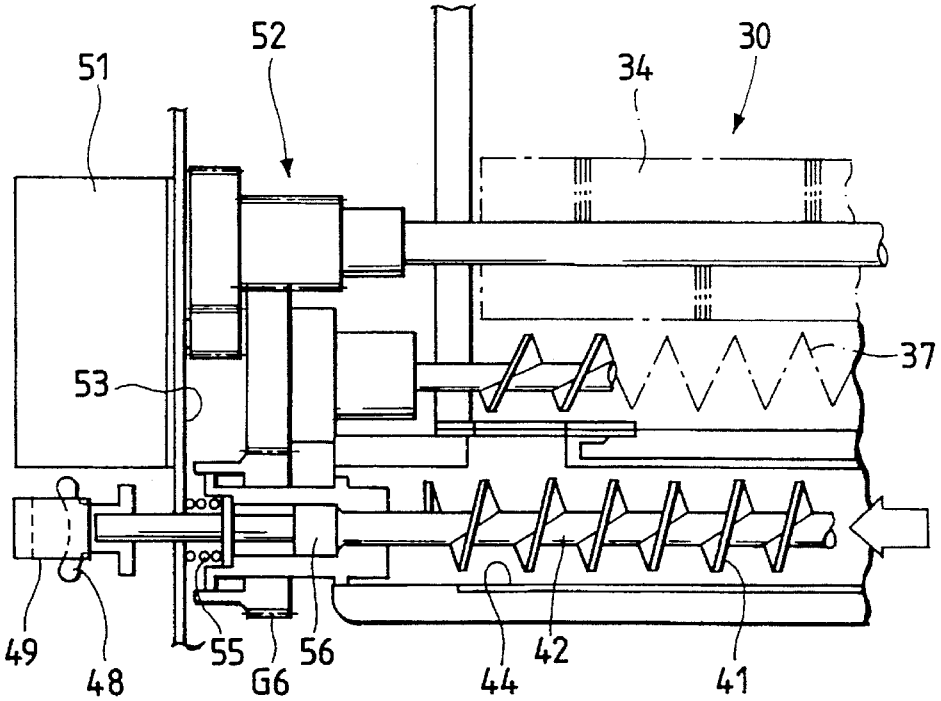
FIG. 5 is an illustration showing a state in which a vessel fills with toner.

In FIG. 4, when the storage vessel 40 fills with toner, the reaction force of toner pushed into the storage vessel 40 by the screw member 41 is strongly transmitted to the screw member 41, thus a force moving the shaft 42 of the screw member 41 to the left of the figure acts as shown in FIG. 5. The thrust terminal member 56 moves in a condition compressing the spring 55 and the actuator 48 placed at the end of the shaft 42 is sensed by the sensor 49, thus the state in which the storage vessel 40 fills with collected toner can be sensed according to sensing information from the sensor 49. Therefore, in FIG. 4, the state in which the storage vessel 40 fills with toner can be precisely sensed by previously adjusting the force of the spring 55 so that the shaft 42 of the screw member 41 moves only when the storage vessel 40 fills with collected toner.

(Embodiment 2)

Figure 6:
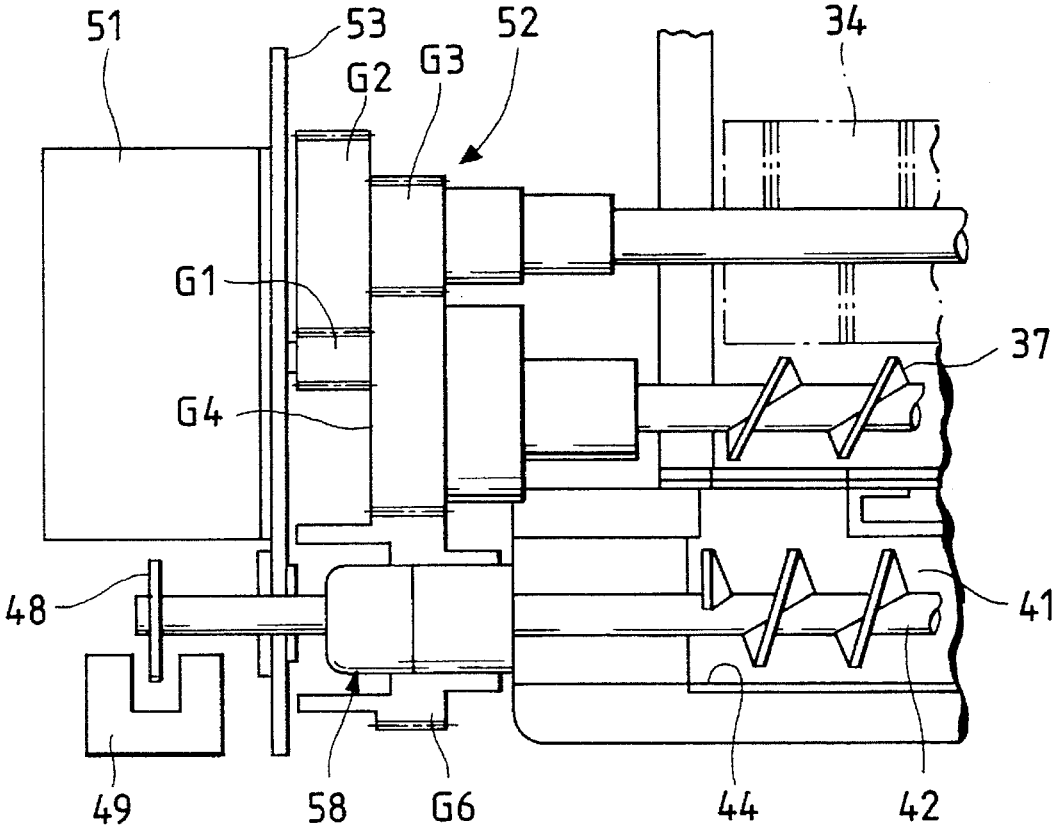
FIG. 6 is an illustration of another embodiment of full sensing means of the invention.
Figure 7:
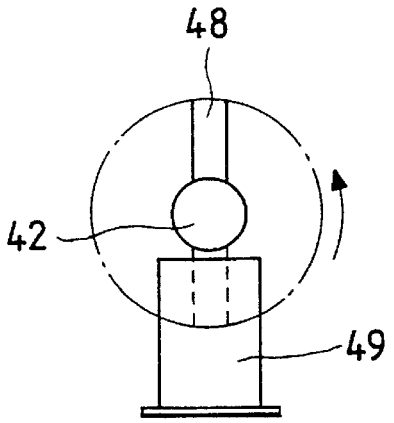
FIG. 7 is an illustration showing the relationship between a sensor and an actuator in FIG. 6.

Apart from the embodiment shown in FIG. 4, in the invention, means for sensing that the number of revolutions of a screw member varies depending on resistance when toner is pushed into a vessel can be used without placing the shaft of the screw member slidably for a thrust bearing. In FIG. 6, a torque limiter 58 is placed between a drive gear G6 for a screw member of a drive and a shaft 42 of the screw member for screw member 41 located in a storage vessel. An actuator 48 rotating integrally with the shaft is placed at the end of the shaft of the screw member and as shown in FIG. 7, a sensor 49 senses rotation of the actuator 48, whereby the rotation state of the screw member can be sensed. Since the sensor 49 is formed as an optical sensor of transmission type, the actuator 48 shuts off an optical path between a light emitting member and a light receiving member, whereby a sense signal is output to a controller like pulses.

In FIG. 6, the torque limiter 58 is caused to slide in response to an increase in resistance to driving the screw member in a state in which a toner storage section of the storage vessel fills with toner when the screw member 41 transports toner inside a pipe 44 placed in the storage vessel. For actuator sensing information provided from the sensor sensing rotation of the shaft, for example, a pulse signal output from the sensor becomes a given timing in a state in which the shaft 42 of the screw member is driven a given number of revolutions.

In contrast, when the vessel fills with toner, if an attempt is made to turn the screw member for further pushing toner into the vessel, large resistance is applied to the screw member, thus a torque limiter sliding state occurs. When the number of revolutions of the shaft of the screw member reduces, the number of pulse signals provided from the sensor per given time falls below a setup value. Further, when it becomes impossible to feed toner into the vessel by the screw member and the screw member stops turning, the sensor does not output any actuator sensing signal. Therefore, in FIGS. 6 and 7, the state in which the storage vessel fills with toner can be easily sensed by providing drive force transmission means via the torque limiter for the shaft 42 of the screw member.

When the state in which the storage vessel fills with toner is sensed, a message instructing the operator to replace the storage vessel with a new one is displayed on a display section of a control panel of an image formation unit and at the same time, counting down the number of copies enabled to inhibition of the image formation operation (for example, 2000 copies) is started by a counter in the image formation unit. When the count value to copy inhibition reaches 0, the image information unit is disabled from performing the image formation operation, whereby toner can be prevented from overflowing the storage vessel.

Figure 8:
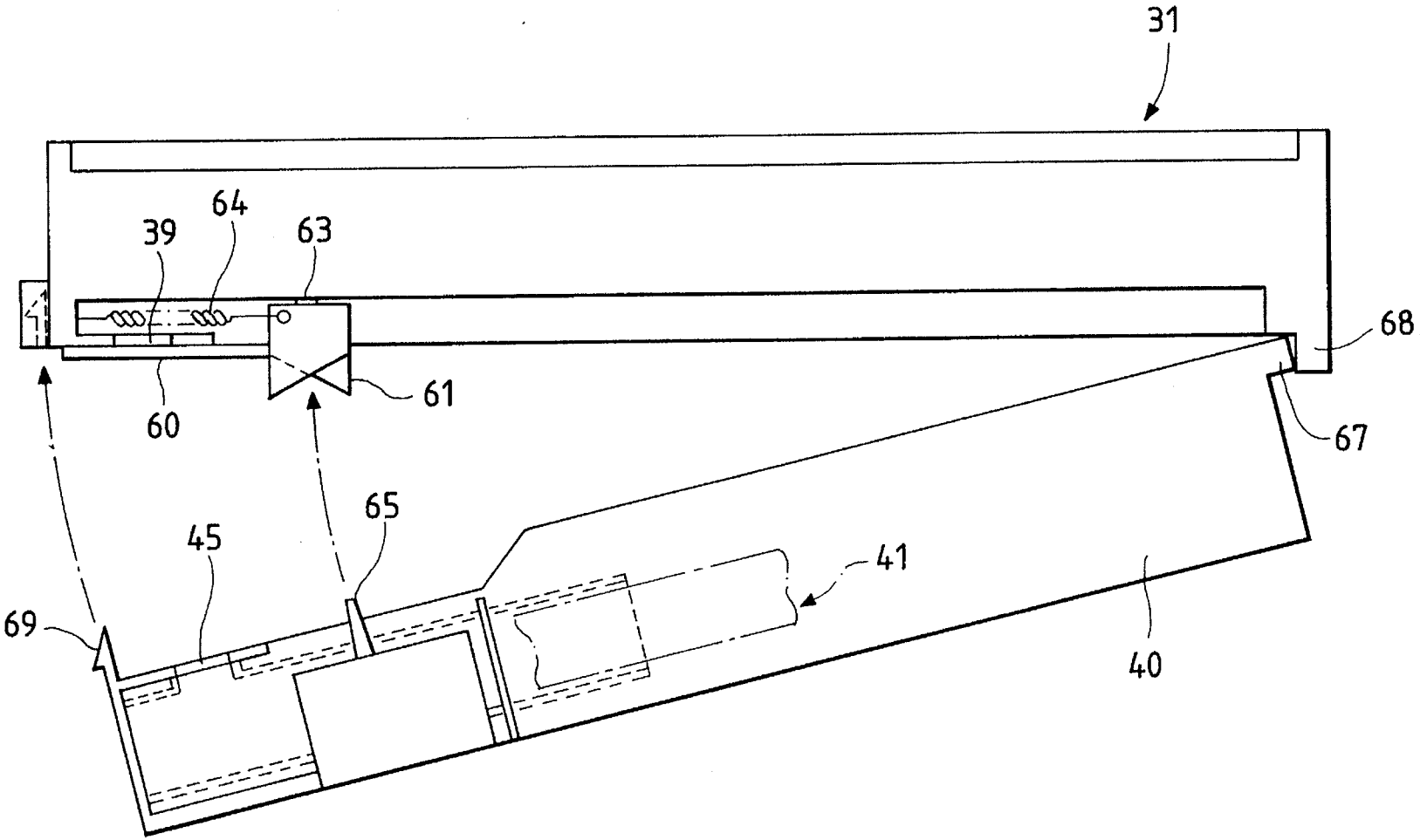
FIG. 8 is an illustration of a state in which a storage vessel is being mounted on a main unit.
Figure 9:
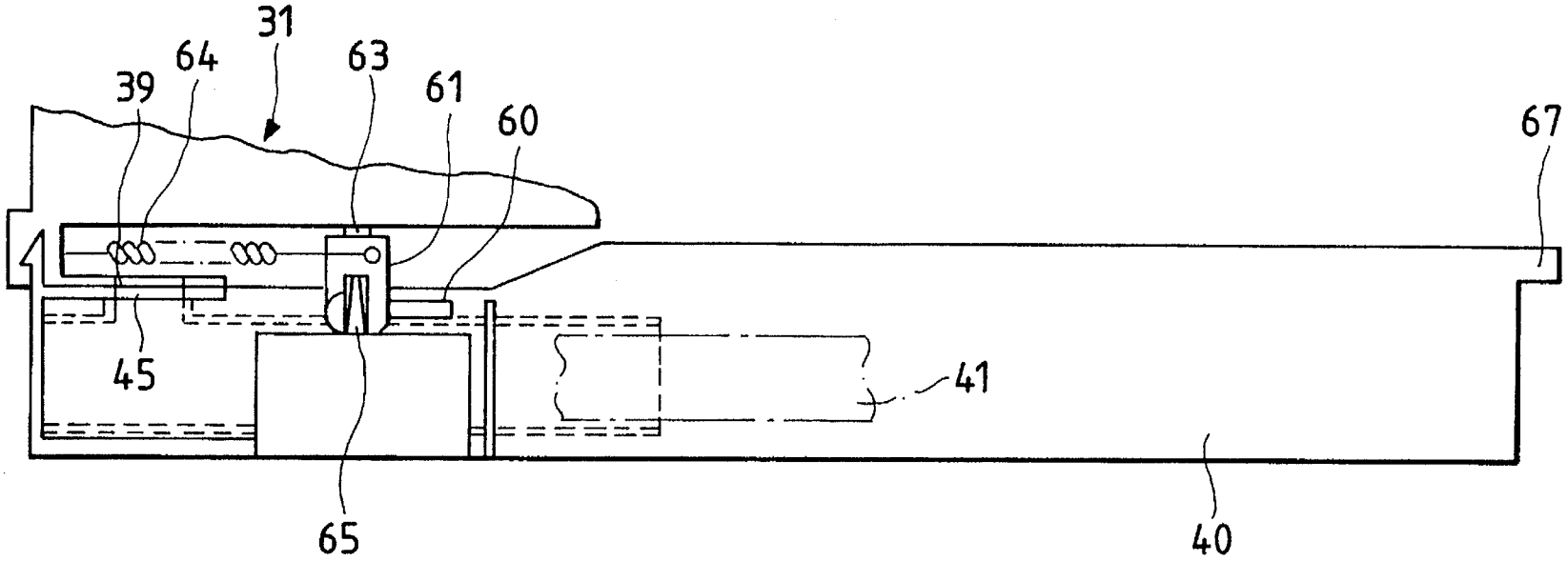
FIG. 9 is an illustration of a state in which the storage vessel has been mounted on the main unit.

In addition to the mechanism for sensing the state in which the vessel fills with toner as described above, in the invention, to mount the storage vessel 40 on the main unit 31 of the cleaning unit 30, an engagement claw 67 provided at one end of the storage vessel 40 is engaged in a reception part 68 of the main unit 31, as shown in FIG. 8. Also, a lock member 69 located at an opposite end of the storage vessel 40 is locked in a lock member located in the main unit 31, thereby positioning the storage vessel for the main unit 31 and connecting drive means at both members. Further, means for automatically opening and closing a shutter member 60 disposed at the discharge port 39 of the main unit 31 by a shutter opener 65 located in the storage vessel is provided to transfer toner between both the members. As shown in FIG. 9, the discharge port 39 of the main unit 31 can be opened by mounting the storage vessel 40 on the main unit 31.

Figure 10:
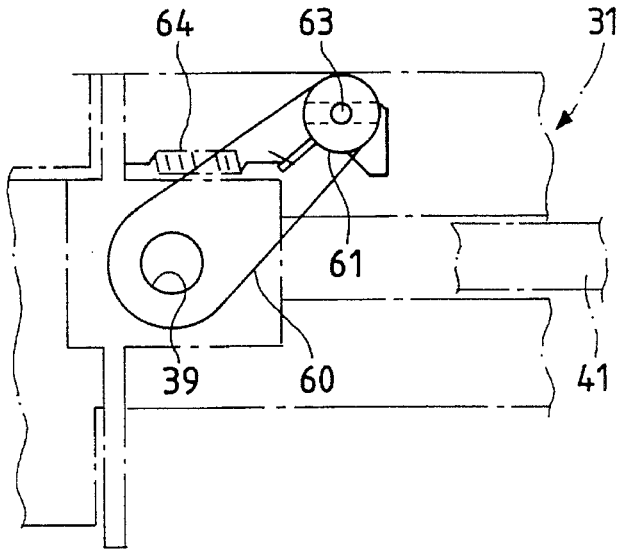
FIG. 10 is an illustration showing the structure of a shutter member for the main unit.
Figure 11:
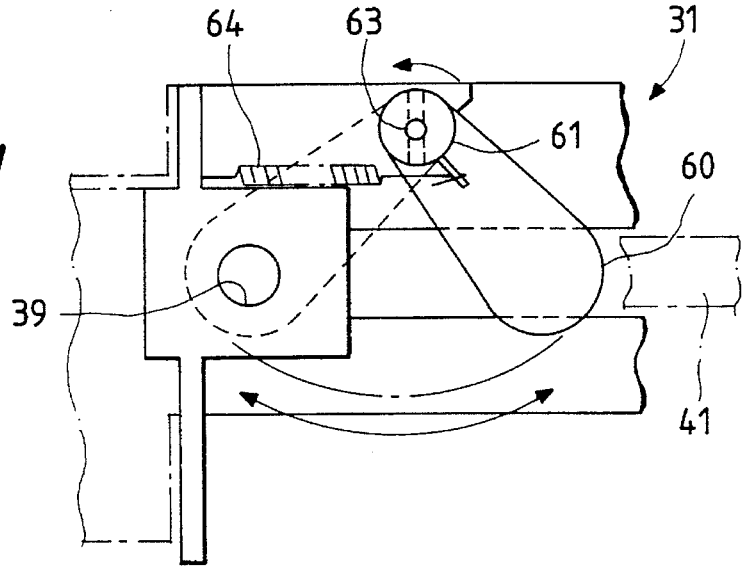
FIG. 11 is an illustration of a state in which the shutter member is opened.
Figure 12:
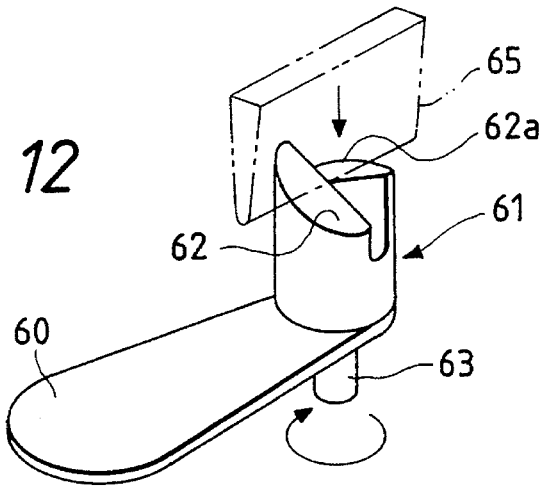
FIG. 12 is a perspective view showing the structure of a cam member for the shutter member.

The shutter member 60 is placed for the discharge port 39 of the main unit 31; the shutter member 60 supported on the frame of the main unit via a supporting shaft 63 is integral with a cam member 61 for rotating the shutter member, as shown in FIGS. 10 to 12. The cam member 61 comprises cam faces 62 and 62*a* 903 inclined on opposite sides with the center as the boundary, as shown in FIG. 12. The linear shutter opener 65 is pressed against the cam faces 62 and 62*a* by mounting the storage vessel on the main unit, whereby the cam member 61 rotates with the supporting shaft as the center, rotating the shutter member 60, so that the discharge port is automatically opened. The spring 64 is placed for the rotation member, whereby the state in which the shutter member closes the discharge port is maintained when the cam member does not undergo rotation.

In the discharge port opening/closing mechanism of the main unit having the structure as described above, when the storage vessel 40 is being mounted on the main unit from the state shown in FIG. 8, the shutter opener 65 projected from the storage vessel engages the cam member 61 and further the storage vessel is pressed against the main unit, whereby the cam member 61 rotates via the supporting shaft. From the state in FIG. 10, the shutter member 60 rotates as shown in FIG. 11, whereby the passage for distributing toner from the main unit to the storage vessel (discharge port) is connected. A shutter member for sliding to the opening can be placed for the receptacle 45 of the storage vessel and can be provided with energizing means such as a spring and means for moving the shutter member following the operation attaching or detaching the storage vessel to or from the main unit can be provided.

In the invention, means for manually opening or closing the shutter member can also be provided. If the manual opening/closing means is placed at the receptacle of the storage vessel, when the storage vessel filling with toner is removed, the shutter member is closed before the storage vessel is removed from the main unit, whereby toner can be prevented from leaking out. In the unit of the invention having the structure as described above, the structure of the shutter member for the toner transfer part between the two devices is not limited to use of the means as shown in the embodiment. In addition, any conventional aperture opening/closing means used to transfer toner can be provided.

In addition to the structure as described above, in the invention, lock means, etc., for mounting the storage vessel on the main unit and holding it can also be made of any means. The cleaning unit of the invention can be placed not only for paper conveyer belts, but also for image supports such as photosensitive drums, photosensitive belts, and intermediate transfer belts. Further, the cleaning unit of the invention enables the collected toner storage vessel to be mounted at any desired position of the main unit and can efficiently store toner in the storage vessel with the toner pushed into the vessel by the screw member.

(Embodiment 3)

Figure 13:
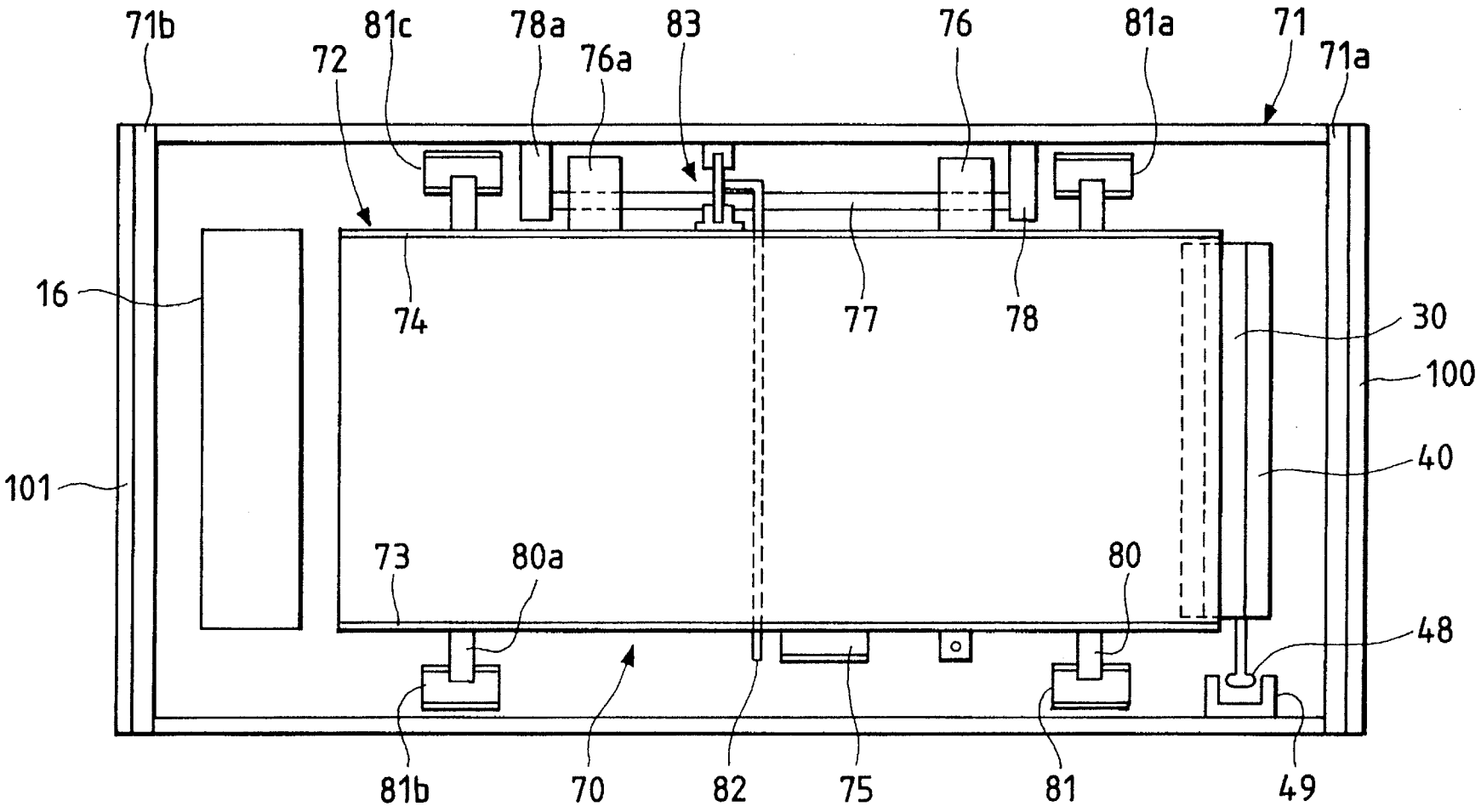
FIG. 13 is an illustration of an example of placing a transport belt of the invention in a transfer module.
Figure 14:
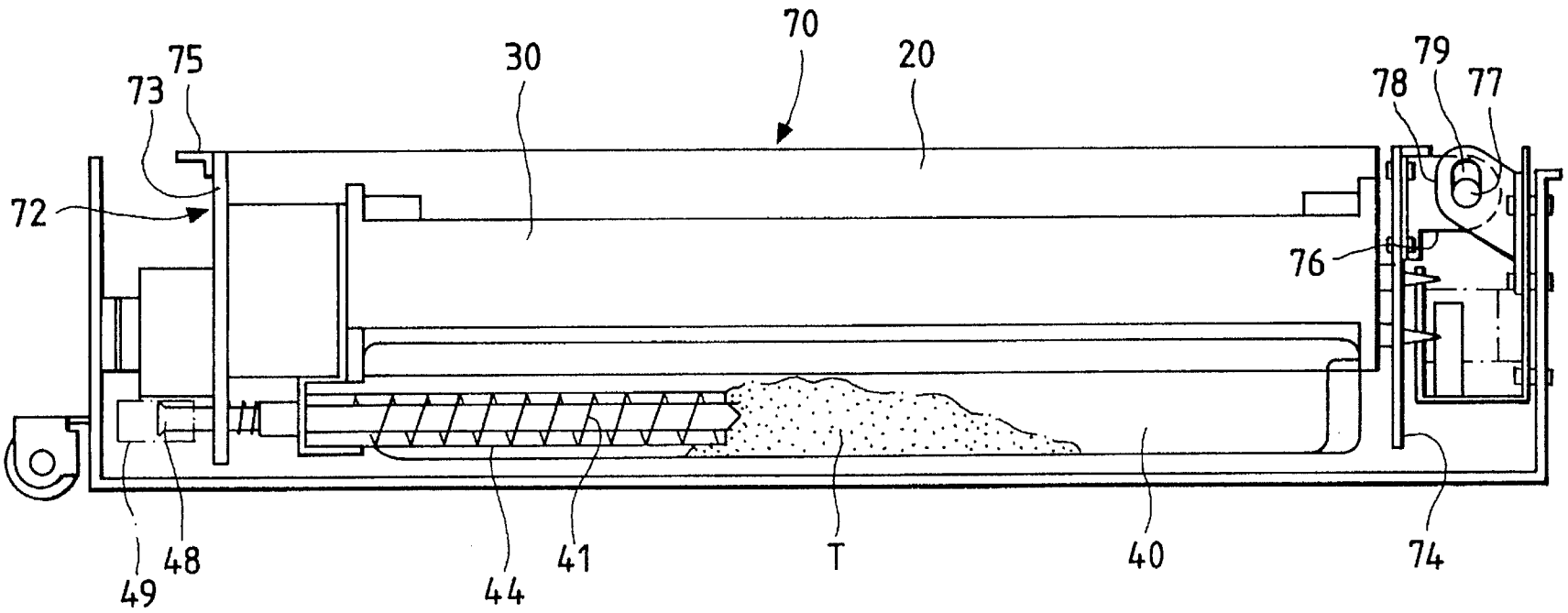
FIG. 14 is a side view of the transfer module in FIG. 13.

In addition to the structure in which the cleaning unit and the collected toner storage vessel are placed for the conveyer belt 20 as in the embodiment discussed above, in the invention, conveyer belt 20 and guide roller members, etc., can also be built in a module frame 72 in one piece to make up a transfer module 70, as shown in FIGS. 13 and 14. In FIG. 13, a main unit frame 71 for supporting the module frame 72 has a structure in which frame members 71*a* and 71*b* placed in a direction perpendicular to the running direction of the belt are guided by means of guide rails 100 and 101 disposed in the main unit of image formation unit and the module frame 72 can be drawn out in a horizontal direction from the main unit of the image formation unit. The module frame 72 comprises a front frame 73 and a rear frame 74 placed on both sides of the module frame 72 in parallel with the belt running direction and a member (not shown) connecting the frames 73 and 74. As shown in FIG. 13, cleaning unit 30 for cleaning the belt surface can be mounted on the module frame 72 in one piece.

Further, the module frame 72 is disposed swingably via a supporting shaft member 77 for the main unit frame 71 placed in the upper part of the main unit of the image formation unit. To swing the module frame 72, the supporting shaft member 77 is fixed to brackets 76 and 76*a* projected to the rear frame 74 and is supported by brackets 78 and 78*a* located in the main unit frame 71 and a handle 75 located on the front frame 73 is used to swing the module frame 72 via the supporting shaft member. To maintain the transfer module 70 or replace the collected toner storage vessel, the module frame 72 is drawn out in a horizontal direction along the guide rails of the main unit of the image formation unit and the transfer module is exposed to the front of the image formation unit, then the main unit frame is swung via the supporting shaft member and the front of the module frame 72 is elevated.

A fixing device 16 for guiding and fixing paper stripped and discharged from the end of the conveyer belt 20 is placed for the main unit frame 71. A paper transport passage can be connected to the fixing device 16 with the module frame 72 placed at a paper transport position. Support rod members 80 and 80*a* are placed on the module frame 72 in a state in which they penetrate both the front and rear frames 73 and 74. Support members 81, 81*a*, 81*b*, and 81*c* are placed for projections of the support rod members 80 and 80*a* from the frames for supporting the module frame 72. The support members 81, 81*a*, 81*b*, and 81*c* are provided as members for moving up and down the module frame 72. To maintain the unit, they are used to move down the module frame 72 for separating the belt from members such as photosensitive drums. A rotation operation lever 82 and a lock member 83 are provided to swing the module frame 72 via the supporting shaft member 77 and hold the module frame 72 at the swing position. The lock member 83 is formed with a lock mechanism for holding the module frame 72 at the position at which it is swung by handling the rotation operation lever 82 and fixing the module frame 72 to the operational position of the module frame 72.

FIG. 14 shows a state in which the device shown in FIG. 13 is viewed from the cleaning unit 30 which is placed upstream of the portion where the conveyer belt 20 is guided by a drive roller. Since a pipe 44 is extended to an intermediate part of a storage vessel 40 attached to the cleaning unit 30 as shown in FIG. 14, toner T transported in the pipe 44 by a screw member 41 accumulates in the opening end of the pipe 44. The toner T collected and accumulated at the end of the discharge end of the screw member 41 as described above is further discharged to the inside of the storage vessel 40 and pushed into the depth of the vessel 40, which will fill with the toner T.

Figure 15:
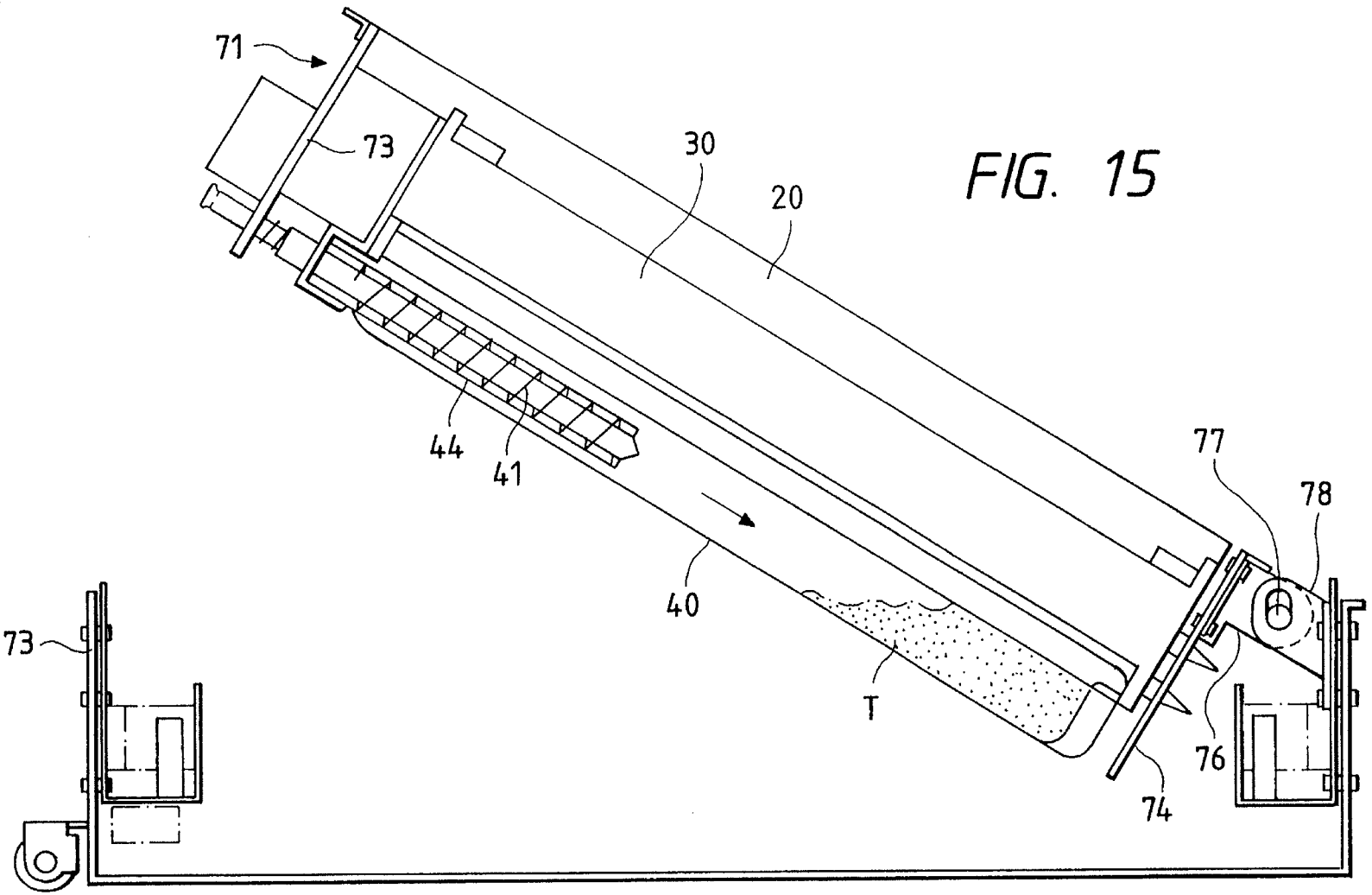
FIG. 15 is an illustration of a toner move state in a storage vessel in condition in which a module frame is swung.

To maintain the transfer module 70 or a process device, etc., placed surrounding the transfer module 70 in the unit of the invention, the transfer module 70 is drawn out to the front of the unit along the guide rails disposed in the main unit of the image formation unit. After this, the module frame 72 is swung via the supporting shaft member 77 for the main unit frame 71, as shown in FIG. 15. When the module frame 72 is swung, the cleaning unit 30 integral with the module frame 72 is swung together with the storage vessel 40 for attempting to incline the storage vessel 40. The toner T stored in the storage vessel 40 moves to the rear of the vessel, forming a space in the discharge end of the pipe 44. Since the module frame swinging operation is repeated each time the unit is maintained, the function of preventing toner from accumulating in the discharge end of the pipe can be automatically executed by swinging the module frame 72 via the supporting shaft member 77.

Therefore, in a condition in which the toner T stored in the storage vessel 40 can be pushed into the rear deeper than the discharge end of the pipe 44, the toner T can be automatically moved in the vessel 40 by inclining the module frame 72. Further, in a condition in which the vessel 40 fills with the toner T to the front beyond the discharge end of the pipe 44, even if the module frame 72 is swung via the supporting shaft member, the toner does not move in the storage vessel 40 and is forcibly pushed into the vessel 40 by the screw member 41, and a reaction force caused by pushing the toner into the vessel acts on a shaft 42 of the screw member 41. As described above, the rotation state of the shaft 42 of the screw member 41 is sensed by a sensor, outputting a signal indicating that the storage vessel 40 fills with the collected toner.

Figure 16:
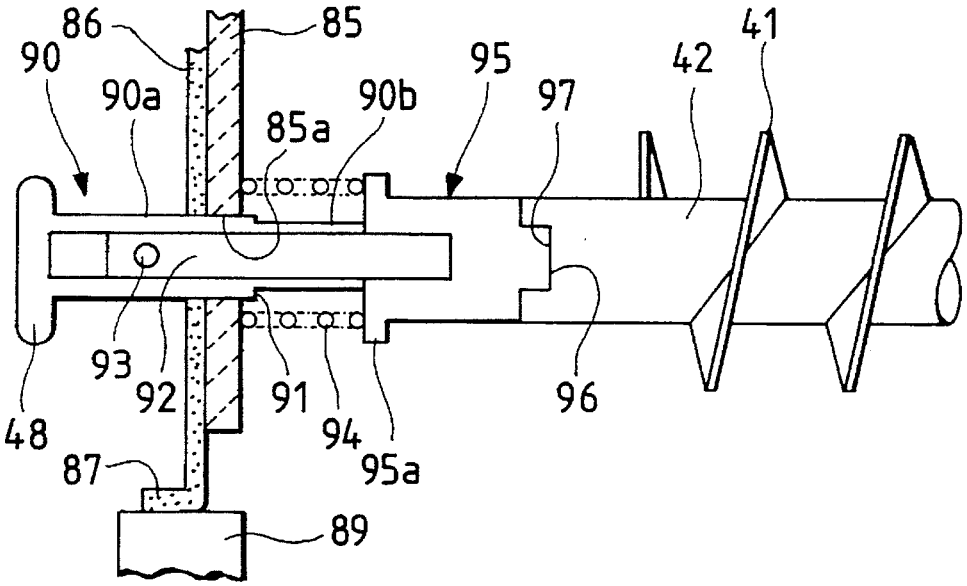
FIG. 16 is an illustration of a drive transmission mechanism of a screw member placed in the storage vessel.

As described above, in the transfer module 70 in which the conveyer belt 20 and the cleaning unit 30 are built in one piece, the screw member 41 disposed in the storage vessel 40 forms means for connecting the shaft 42 and an actuator 48 and sensing rotation of the screw member 41 by the sensor using the actuator 48, as shown in FIG. 16. The actuator 48 is located in a knob 90 which is attached to a shaft member 92 with a pin 93. A connection member 95 is fixed to the tip of the shaft member 92 in one piece. A spring 94 is placed between the tip formed with a large-diameter flange 95*a* of the connection member 95 and a frame 85 supporting the cleaning unit 30 for energizing the connection member 95 toward the screw member 41 of the storage vessel 40. A lock part 96 disposed at the tip of the storage vessel 40 is connected to a locked part 97 disposed at the end of the shaft 42 of the screw member 41.

The frame 85 is formed with a shaft hole 85*a* through which a large diameter part 90*a* of the knob 90 passes and the shaft hole 85*a* forms means for allowing the large diameter part 90*a* to rotate and axially slide. Further, a plate 86 made of a thin plate member is placed outside (left of) the frame 85 so that it can be slid up and down. A bend 87 placed on the bottom of the plate 86 elevates the plate 86 in a condition in which it rides on a block 89 so that a shaft hole made in the plate 86 matches the shaft hole 85*a* of the frame 85. In addition to the support means formed by the frame, the connection member 95 is formed integrally with a drive gear for the screw member as shown in FIG. 3. In a condition in which the lock part 96 of the connection member 95 is engaged with the locked part 97 located on the shaft 42 of the screw member, rotation of the connection member 95 is transmitted to the screw member for transporting toner in the storage vessel. As the screw member rotates, the knob 90 is rotated via the shaft member 92 and rotation of the actuator 48 integral with the knob 90 is sensed by the sensor, outputting a screw member rotation signal.

Figure 17:
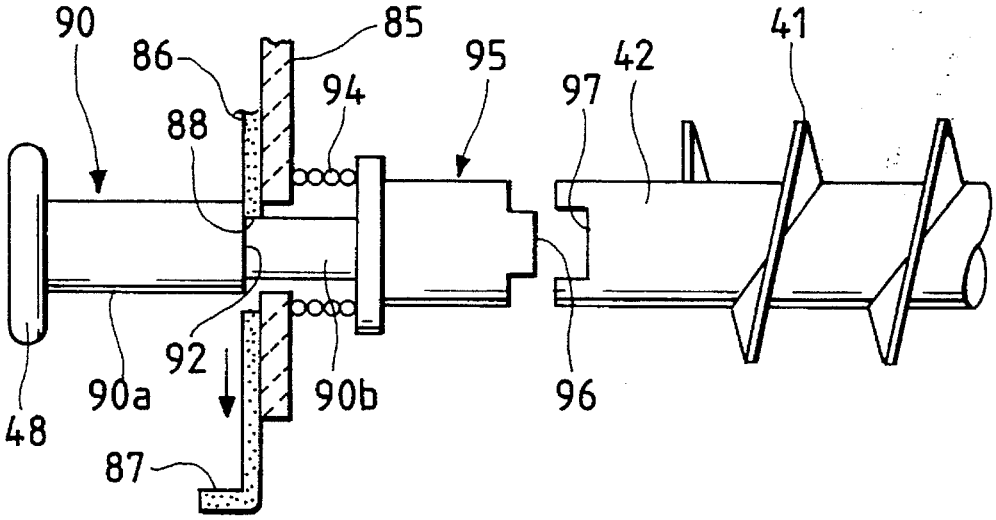
FIG. 17 is an illustration of a state in which drive transmission to the screw member is shut off.

The screw member shown in FIG. 16 indicates a state in which the transfer module is set to an operational position, wherein toner adhering to the conveyer belt can be removed by the cleaning unit and collected in the storage vessel 40. In contrast, to swing the transfer module 70 as shown in FIG. 15 for taking off the storage vessel 40 or turn off driving the screw member, the knob 90 is moved in the direction away from the shaft 42 of the screw member, as shown in FIG. 17. When the knob 90 is moved in the left direction of the figure while the spring 94 is being compressed, a step part 91 made in the shaft member 92 of the knob 90 is detached from the support position of the frame 85 and further moves to the left. The plate 86 disposed slidably for the frame 85 falls due to its own weight and is engaged with the step part 91 between the large diameter part 90*a* and a small diameter part 90*b* of the shaft member of the knob 90 and is locked to a position projecting the knob 90; even if the operator looses his or her hold of the knob 90, the knob projecting state can be maintained.

When the storage vessel is replaced in a condition in which drive transmission of the storage vessel to the screw is disabled as described above and then the transfer module is restored to the operational position, lock by the plate 86 can be automatically released without need for the operation of manually pushing in the knob. Since the bend 87 of the plate 86 engages the block 89 during the operation of restoring the transfer module to the operational position, the plate 86 slides for the frame 85 and relatively rises. Thus, the lock state of the step part 91 is released while the plate is rising. The knob 90 slides to the shaft of the screw by the force of the spring 94 and is connected in a state in which drive transmission can be executed as shown in FIG. 16. It is set to a position at which the actuator is sensed by the sensor.

As described above, in the unit of the invention, the shaft of the transport means placed in the collected toner storage means is divided into the shaft 42 of the screw member 41 placed in the toner transport section and the shaft 92 of the actuator 48 (knob 90) and the connection means 96 and 97 are located between the two shafts. The supporting shaft of the actuator as means for sensing the rotation state of the shaft for the transport means placed in the collected toner storage means can be moved among the first position before the sensor 49 senses that the collected toner storage means fills with toner, the second position for the sensor 49 to sense the actuator 48 and sense that the collected toner storage means fills with toner, and the third position for mounting or demounting the collected toner storage means. Further, at the third position for mounting or demounting the collected toner storage means, the shaft on the actuator side is moved to the side opposite to the collected toner transport direction and locked and the two shafts are disconnected from each other. In this state, the collected toner storage means can be mounted or demounted.

In addition to the structure, in a state in which the transfer module is drawn out horizontally to the main unit frame of the image formation unit and swung at a position where the transfer module is furthermore drawn out, the shaft on the actuator side is moved to the side opposite to the collected toner transport direction and locked and the collected toner storage means can be mounted or demounted. Then, in a state in which the transfer module is restored to the horizontal position, the shaft on the actuator side is automatically unlocked and the actuator shaft is connected to the screw member shaft so that the sensor can sense that the storage vessel fills with toner. To form the actuator integrally with the knob, the structure of the actuator as a sensed member placed in the knob can be selected corresponding to sensing of shaft rotation by the sensor or sensing of a state in which the shaft is axially moved.

Since the cleaning device for the image formation unit of the invention has the structure as described above, means for writing marks to sense the image density, etc., onto the conveyer belt supporting paper and controlling the copy image density, etc., and when paper is supported, the marks can be removed by the cleaning unit. The cleaning unit has the collected toner storage vessel disposed detachably in the main unit and when the vessel fills with toner, it can be replaced with a new one. Further, the screw member for pushing toner into the storage vessel is placed for the vessel. When the vessel fills with toner, if resistance to the screw member increases, stopping rotation of the screw member or moving the screw member axially, the sensor can sense that the vessel fills with toner according to the state of the screw member.

Since the opening for transferring toner between the transport screw member of the main unit and the screw member of the storage vessel is opened by mounting the storage vessel of the invention on the main unit, if the vessel provided with the screw member is not connected, toner does not leak out. In addition to the structure, in the invention, the conveyer belt and the support member are formed as the transfer module and the transfer module can be swung via the supporting shaft member disposed in the main unit of the image formation unit. The cleaning unit and the storage vessel are previously attached to the transfer module, whereby when the transfer module is inclined in maintenance, etc., of the transfer module, toner in the storage vessel is moved to the depth of the vessel so that the depth side of the vessel into which toner is hard to be pushed by the screw can also fill with toner. Therefore, toner accumulating in the part of the screw member placed in the storage vessel can be removed by inclining the transfer module, so that load when the later collected toner is transported by the screw can be reduced and the transport section is not clogged with toner, preventing erroneous sensing at the transport section.

The cleaning unit for the image formation unit according to the invention has the screw member movable in the toner storage vessel and senses a move of the screw member by the sensor for sensing that the toner storage vessel fills with toner, thus can prevent erroneous sensing that the vessel fills with toner as compared with conventional units having a sensor in a toner storage vessel and directly sensing that the vessel fills with toner.

The cleaning unit for the image formation unit according to the invention has the screw member movable in the toner storage vessel and senses the rotation state of the screw member by the rotation sensing sensor for sensing that the toner storage vessel fills with toner, thus can prevent erroneous sensing that the vessel fills with toner as compared with conventional units having a sensor in a toner storage vessel and directly sensing that the vessel fills with toner.

The image formation unit according to the invention comprises the transfer module being swingable for the main unit frame in a state in which the main unit frame is drawn out from the main unit of the image formation unit, and the cleaning unit being integral with the transfer module and having at least the toner storage vessel. Thus, the toner storage vessel can also be swung by swinging the transfer module, preventing toner from accumulating in the vicinity of the toner storage port of the toner storage vessel.

What is claimed is:

1. A cleaning unit for an image formation unit, comprising;

a main unit frame removably insertable into the image formation unit;

a transfer module supporting a paper support element;

a cleaning member placed in contact with the paper support element;

a toner storage vessel for storing waste toner;

a guide member located to receive toner dropping from a bottom of said cleaning member and to direct the received toner to said toner storage vessels;

a screw member having a portion located outside of said toner storage vessel and movable in said toner storage vessel; and a sensor located on the outside of said toner storage vessel for sensing rotation of said screw member wherein said transfer module, said cleaning member and said toner storage vessel form an integral unit, the integral unit being swingable from said main unit frame when said main unit frame is removed from the image formation unit.

2. The cleaning unit of claim 1, further comprising:

an energizing member for suppressing a move of said screw member.

3. A cleaning unit for an image formation unit, comprising:

a main unit frame removably insertable into the image formation unit;

a cleaning member placed in contact with the belt papers support;

a transfer module supporting a paper support element;

a toner storage vessel for storing waste toner;

a guide member located to receive toner dropping from a bottom of said cleaning member and to direct the received toner to said toner storage vessel;

a screw member having a portion located outside of said toner storage vessel and movable in said toner storage vessel; and a sensor located on the outside of said toner storage vessel for sensing of said screw member;

wherein said transfer module, said cleaning member and said toner storage vessel form an integral unit, the integral unit being swingable from said main unit frame when said main unit frame is removed from the image formation unit.

4. An image formation unit, comprising:

a main unit of said image formation unit;

a main unit frame removably insertable into said main unit;

a transfer module supporting a paper conveyer belt and swingable from said main unit frame when said main unit frame is removed from said main unit of said image formation unit;

a screw member having a portion located outside of said toner storage vessel and movable in said toner storage vessel;

a sensor located on the outside of said toner storage vessel for sensing movement of said screw member; and a cleaning unit being integral with said transfer module and having at least a toner storage vessel.

5. The image formation unit of claim 4, wherein said cleaning unit includes a screw member positioned in said toner storage vessel, said screw member divided into a toner transport part and a sensed part, and a lock member for locking said sensed part of said screw member in a state in which said main frame is moved to said main unit frame, when said transfer module is swung from said main unit frame.

6. The image formation unit of claim 5, further comprising:

an unlock member for unlocking said sensed part of said screw member locked to said main unit frame when said transfer module is mounted on said main unit frame.

7. An image formation unit, comprising:

a main unit of said image formation unit;

a main unit frame removably insertable into such main unit;

a transfer module supporting a paper conveyer belt and swingable from said main unit frame said main unit frame is removed from said main unit of said image formation unit;

a screw member, having a portion located outside of said toner storage vessel and movable in said toner storage vessel;

a sensor located on the outside of said toner storage vessel for sensing rotation of said screw member; and a cleaning unit being integral with said transfer module and having at least a toner storage vessel.

* * * * *